United States Patent [19]

Hoffmann

[11] Patent Number: 4,577,348

[45] Date of Patent: Mar. 25, 1986

[54] GAS-TIGHT PROTECTIVE GARMENT WITH HOOD

[75] Inventor: Wilfried Hoffmann, Berlin, Fed. Rep. of Germany

[73] Assignee: Auergesellschaft GmbH, Berlin, Fed. Rep. of Germany

[21] Appl. No.: 407,122

[22] Filed: Aug. 11, 1982

[51] Int. Cl.[4] ..... A62B 17/00

[52] U.S. Cl. ..... 2/84; 2/79; 2/202; 128/206.23

[58] Field of Search ..... 2/205, 202, 84, 79, 2/5, 424, 82, 83, 2.1 R, 2.1 A; 128/201.23, 201.25, 201.29, 206.23, 206.24

[56] References Cited

U.S. PATENT DOCUMENTS

| | | | |
|---|---|---|---|
| 2,577,607 | 12/1951 | Cowley | 128/201.25 |
| 2,583,304 | 1/1952 | Pipher | 128/201.25 |
| 2,935,985 | 5/1960 | Andrews et al. | 128/201.23 |
| 3,660,850 | 5/1972 | Garbisch | 2/205 X |
| 4,186,736 | 2/1980 | Angioletti et al. | 128/201.25 X |
| 4,272,851 | 6/1981 | Goldstein | 2/79 |

*Primary Examiner*—H. Hampton Hunter

*Attorney, Agent, or Firm*—Carothers & Carothers

[57] ABSTRACT

Mounted in the front wall region of a hood is a curved replaceable facepiece lens. In order to obtain a gas-tight joint between the rigid component constituting the facepiece lens and the flexible garment material, as well as obtaining a distribution of the stresses which occur in the region of the junction between the facepiece lens and the garment material, a spherically-bent frame is enclosed by an overlapping cloth frame in the region of the opening for the facepiece lens and forms a firm connecting rim. Located as a seal between the said connecting rim and the rigid facepiece lens is an elastic coupling gasket.

7 Claims, 3 Drawing Figures

GAS-TIGHT PROTECTIVE GARMENT WITH HOOD

The invention concerns a gas-tight viewing window for a protective garment hood, the front wall of which hood is fitted with the facepiece lens or viewing window.

With a known protective garment of this type, the hood, which is made of the same material as the garment and which covers the head, and which is provided with a facepiece lens (or viewing window) made of thin transparent elastic sheet material, is held in place, by means of a nape strap which runs inside the garment, in such a way that the lower edge of the said facepiece lens lies on the breast, the arrangement being such that the transparent sheet material forming the facepiece lens is inserted in the hood with a subsequently glued (or covered) seam.

For the case where it is desired to employ a rigid curved facepiece lens in the facepiece lens opening in the front wall of the hood, instead of transparent elastic sheet material, a major problem arises in the formation of a gas-tight joint between the rigid facepiece lens and the flexible garment material.

Consequently, the basic task of the invention is to construct a hooded protective garment in such a way that a curved rigid facepiece lens is mounted as a window in the front wall of the hood in such a way that it can be attached in a gas-tight and replaceable manner to the flexible material constituting the protective garment.

This task is accomplished in accordance with the invention in conformity with the teaching given in claim 1.

By this means, the tensional forces which occur in the region of the junction between the rigid facepiece lens and the flexible material of the garment are advantageously so distributed that they do not constitute forces which could damage the elastic garment material in the vicinity of the junction.

An embodiment of the invention is shown by way of example in the appended drawings and will be described in greater detail in the following.

Figure 1:
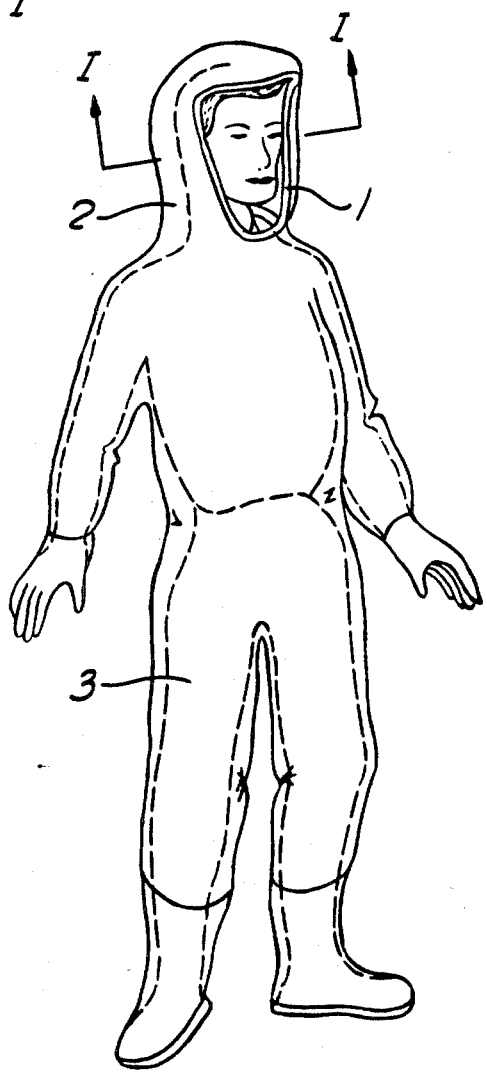
FIG. 1 shows a view of the entire protective garment.
Figure 2:
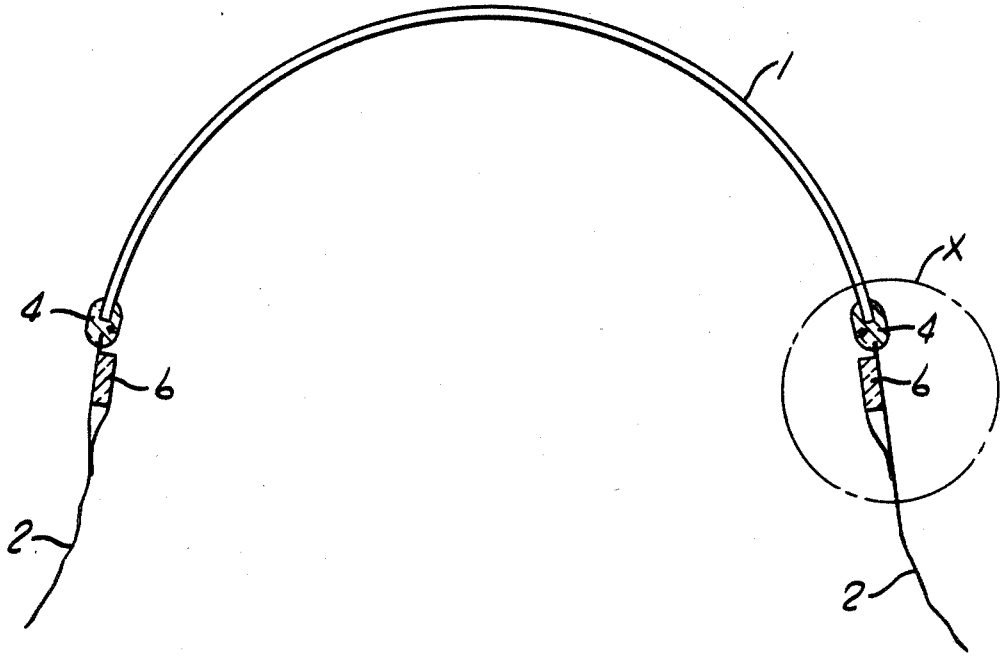
FIG. 2 shows a cross-section taken along the line I—I of FIG. 1.

As may be seen from FIGS. 1 and 2, the window is advantageously made in the form of a curved facepiece lens which is inserted in the hood 2 of the protective garment 3. With this arrangement, the garment wearer advantageously retains his field of view without any limitations.

Figure 3:
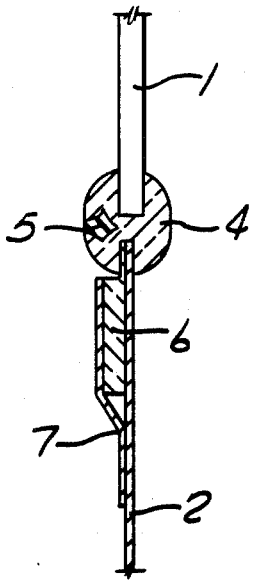
FIG. 3 shows, on an enlarged scale, the feature indicated by X in FIG. 2.

The interchangeable fastening of the facepiece lens 1 in the hood 2 is effected via the above mentioned elastic coupling gasket which takes the form of a sealing profile member 4 and an interfitted filler profile member 5 as shown in FIG. 3. The sealing profile member 4 consists of an endless profiled ring-seal which is firmly mounted, in the cut-out for the window in the hood 2, on a spherically curved rigid frame 6 which is joined to the material constituting the hood 2 (FIG. 3).

The elastic gasket is not permanently affixed to either the frame 6 or the facepiece lens 1, but instead is removable therefrom. More specifically, as shown in FIG. 3, a pair of grooves are formed on opposite sides of the gasket 4 to receive the adjacent portions of lens 1 and frame 6, respectively, into sealing engagement therewithin.

The frame 6 is enclosed by a cloth (or material) frame 7 located on the inside of the hood 2 in the region of the cut-out for the window and forms, in this region, a firm connecting rim which is connected via the profiled sealing gasket 4 to the rigid facepiece lens 1. By this means, the tensional forces which occur in the connecting region between the rigid facepiece lens 1 and the flexible garment material 2 are uniformly distributed.

As clearly shown in FIGS. 3 and 4, the connecting rim of frame 6 projects outwardly to engage the gasket 4. The adjacent peripheral portions of facepiece lens 11 similarly project inwardly to a location outwardly adjacent the connecting rim in a manner that the adjacent peripheral portions of the connecting rim and the facepiece lens 1 are in substantially coplanar spaced relationship as shown, and the gasket 4 extends therebetween.

I claim:

1. A hooded protective garment in which the front wall of a flexible hood has an opening provided with a rigid curved facepiece lens of a given peripheral profile mounted gas-tight therein, characterized in that in the region of the opening for the facepiece lens in the hood the protective garment is firmly attached to and framed by an annular curved frame which conforms to said given peripheral profile, the frame being bound by an overlapping frame of garment material, thus forming a firm connecting rim portion of said frame which is essentially coplanar with respective adjacent peripheral portions of said faceplate lens, and an elastic coupling gasket disposed between and in sealing engagement with peripheral portions of said connecting rim portion and said adjacent coplanar peripheral protions of the rigid curved facepiece lens whereby said gasket secures said facepiece lens with respect to said connecting rim portion continuously along the respective peripheries thereof and constitutes a continuous gas-tight seal between the hood and the facepiece lens.

2. A protective garment in accordance with claim 1, characterized in that the frame is located on the inside wall of the hood in the region of the opening for the facepiece lens.

3. A protective garment in accordance with claim 1, characterized in that the elastic coupling gasket consists of an endless sealing profile member which includes an endless groove that is interfitted with an elongated filler profile member to provide sealed retention of said frame and said facepiece lens with respect to said gasket.

4. A protective garment in accordance with claims 3, characterized in that said filler profile member is selectively removable from the coupling gasket for selective removal and replacement of said facepiece lens and said gasket.

5. A protective garment in accordance with claim 4, characterized in that said gasket extends continuously about said adjacent peripheral portions of the facepiece lens and the connecting rim portion.

6. A protective garment in accordance with claim 5, characterized in that said peripheral portions of the facepiece lens and the connecting rim portion are retained by said gasket in spaced-apart, non-overlapping relationship.

7. A protective garment in accordance with claim 6, characterized in that said gasket includes a pair of grooves which receive said peripheral portions, respectively, in sealing engagement therewith.

* * * * *